United States Patent [19]

MacDonald et al.

[11] 4,005,748

[45] Feb. 1, 1977

[54] ANNULAR HEAT EXCHANGER FINS

[75] Inventors: Robert D. MacDonald, Grand Blanc, Mich.; Robert K. Rose, Burnt Hills, N.Y.

[73] Assignee: Champion Home Builders Co., Dryden, Mich.

[22] Filed: Mar. 14, 1975

[21] Appl. No.: 558,593

[52] U.S. Cl. ..... 165/151; 165/181

[51] Int. Cl.$^2$ ..... F28D 11/00

[58] Field of Search ..... 165/125, 159–161, 165/172, 3, 181; 62/499

[56] References Cited

UNITED STATES PATENTS

| | | | |
|---|---|---|---|
| 1,522,866 | 1/1925 | Colston | 165/161 |
| 1,559,883 | 11/1925 | Karr et al. | 62/499 |
| 2,067,758 | 1/1937 | Flogaus | 165/125 |
| 2,693,942 | 11/1954 | Guala | 165/159 |

*Primary Examiner*—Charles J. Myhre
*Assistant Examiner*—Theophil W. Streule, Jr.
*Attorney, Agent, or Firm*—Cullen, Settle, Sloman & Cantor

[57] ABSTRACT

Annular fins for a heat exchanger are fabricated in circumferential segments, arranged end to end, with each segment having inner and outer edges of identical but radially spaced contour, so that such segments can be stamped from a blank without any scrap created between the common edges of adjacent segments.

4 Claims, 10 Drawing Figures

FIG. 1
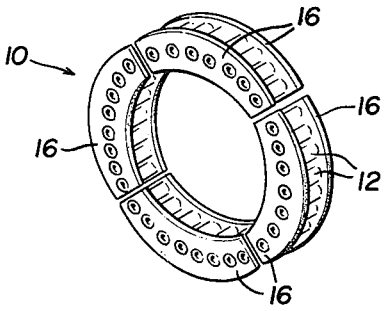
FIG. 2
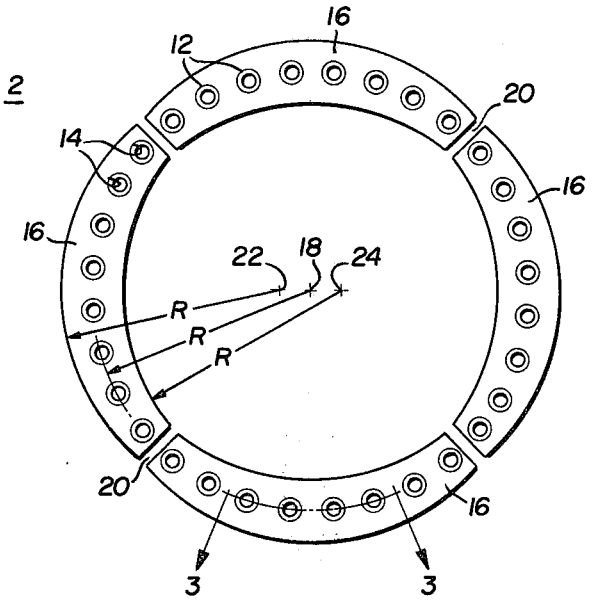
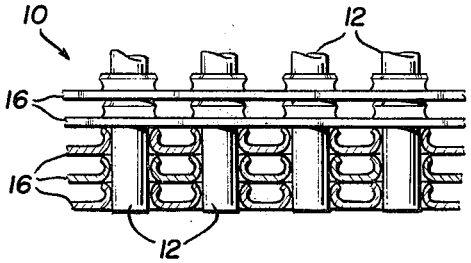
FIG. 3
FIG. 4
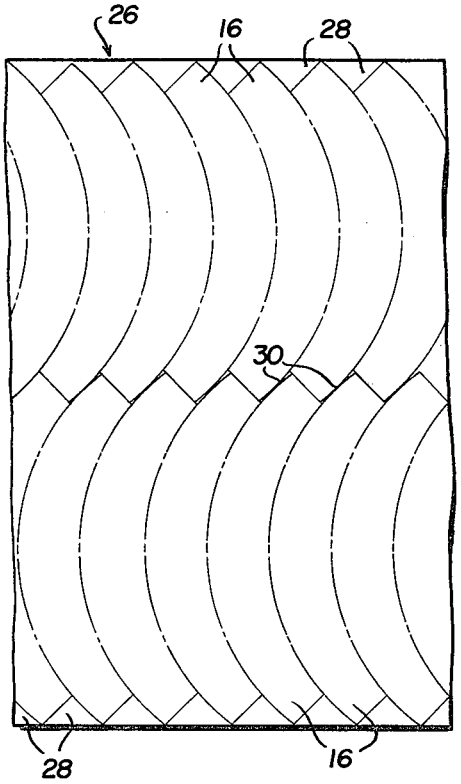
FIG. 5
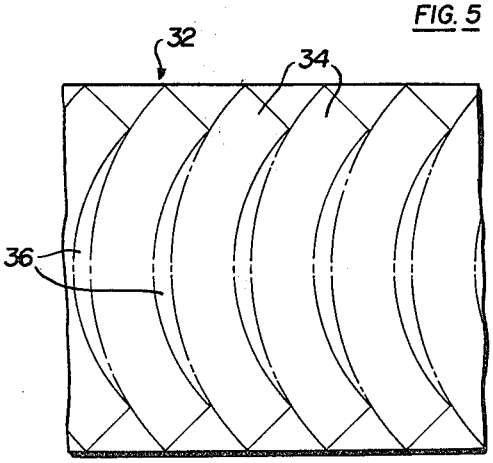

ANNULAR HEAT EXCHANGER FINS

BACKGROUND OF INVENTION

This invention relates to improved heat exchanger construction which permits substantial economies in the cost of fabricating the heat-exchanging annularly-shaped fins. The particular type of heat exchanger disclosed herein comprises a plurality of parallel fluid-carrying tubes arranged in cylindrical fashion, the tubes having a series of thin sheet metal annular fins closely spaced along their length, to enhance the heat exchanging efficiency. Each fin is provided with punched holes to receive an array of tubes. This type of heat exchanger may be mounted for rotation about the axis of the fins, with the rotation establishing an axial air flow into the center of the array and then radially outwardly over the surface of the tubes and fins. Examples of this type of heat exchanger may be found in U.S. Pat. Nos. 3,189,262 and 3,347,059. The word "annular" as used herein refers to any open-center shape, not merely purely circular rings.

To from such a fin as a single annular piece, having an inner diameter of about twelve inches, for example, would result in a substantial quantity of wasted material. In whatever pattern such fins might be arranged on a blank, considerable scrap would necessarily result between adjacent fins as well as from within the annulus.

A first step in increasing the yield from a blank would be to segment the fin, as for example, into four circumferential sections. Then such quarter-fins could be nested together on a blank, with the convex outer circumference of one segment nested in close to the concave inner diameter of an adjacent segment. However, such an arrangement still necessarily produces scrap between adjacent segments.

The invention herein disclosed completely eliminates the scrap between adjacent segments by abandoning the traditional fin configuration wherein the annulus consists of inner and outer concentric circular edges. According to the present invention, each fin is segmented, as described above, and the radius of the arc of the outer circumferential edge is made identical to the radius of the arc of the inner circumferential edge. Thus, the outer circumference of each fin takes on a lobed configuration with an outward bulge in the central portion of each fin segment. Alternative forms employ straight line rather than arcuate segments, while retaining the concept of identical inner and outer edge contours.

The result of this novel fin shape is that the fin segments can be nested perfectly on the blank, without any scrap created between adjacent segments, because the outer contour of one fin segment is identical to the inner contour of the adjacent fin segment. In this manner, the objective of more economical fabrication of the fins has been achieved.

The broad idea of shaping parts to permit line-to-line nesting on a blank is not new. It is disclosed, for example, in British Pat. No. 1553 and U.S. Pat. No. 1,416,949. While these prior art patents show the idea of nesting on a blank, neither of them suggest the essence of the present invention, namely, the abandonment of the traditional shape for an annular fin in the form of two concentric circles of unequal radii and the use instead of a segmented ring having inner and outer edges of identical contour.

BRIEF DESCRIPTION OF THE DRAWINGS

FIG. 1 is a perspective view of a portion of a heat exchanger embodying the improved fins of the present invention.

FIG. 2 is an end view of a typical fin of the present invention, showing the tubes in cross-section.

FIG. 3 is a cross-section through a portion of the fin of FIG. 2, viewed in the direction of arrows 3—3.

FIG. 4 is a plan view of a blank showing in phantom the outline of the fin segments to be formed therefrom, according to the present invention.

FIG. 5 is a view, similar to FIG. 4, but showing this scrap material resulting from the use of an alternative fin design.

DETAILED DESCRIPTION OF THE INVENTION

Figure 10:
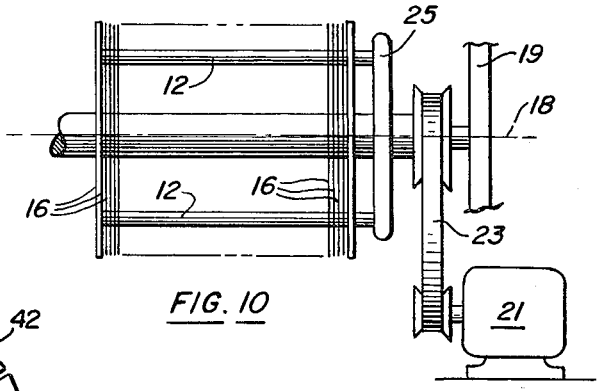
FIG. 10 is a simplified elevation of the heat exchanger and associated drive and mounting means.

FIGS. 1 and 2 illustrate a portion of a typical rotating heat exchanger embodying one form of the present invention. Heat exchanger 10 comprises a plurality of fluid-carrying tubes 12 arranged in parallel laterally spaced generally cylindrical fashion. Tubes 12 pass through holes 14 in a stack of axially spaced annular fin sections 16, this entire construction being rotatably mounted on axis 18 in frame 19 and driven by a motor 21 and belt 23, as shown in FIG. 10. A manifold 25 establishes a fluid circuit among tubes 12, and can be connected to associated equipment, such as a refrigerant compressor, as will be understood by those skilled in the art.

The generally annular fins of the illustrated embodiment thus each consist of four circumferential fin sections 16, arranged end to end but spaced slightly to leave a small circumferential gap 20. This gap, though not essential to the present invention, is useful in that it serves to break the boundary layer which tends to form along the rotating fins, and which interferes with maximum heat exchanging efficiency.

Referring to FIG. 2 in particular, central axis 18 serves as the center for the arc of radius R on which the center of each tube hole 14 lies. Thus, all of the tubes 14 lie on a true circle whose center is the rotational axis 18. The outer circumferential edge of each fin section also describes an arc of identical radius R, but the center for such arc is spaced radially outwardly from axis 18 in a direction toward the associated fin section, such as point 22. Similarly, the inner circumferential edge of each fin section describes an arc of identical radius R, struck from point 24 located on the opposite side of axis 18 from point 22. Such an arrangement provides an equal fin width on both the inner and outer side of each tube hole 14. It will be understood that the above-described system for locating points 22 and 24 relative to central axis 18 is typical of that employed for the other fin sections of FIG. 2. That is, while the arcs on which holes 14 of each section are located all have their centers at common point 18, the location of the centers for the arcs describing the inner and outer edges of each fin section are different for each fin section, with the center for each outer arc lying between axis 18 and such arc, and with axis 18 lying midway between the inner and outer arc centers for each fin section. As shown in FIG. 3, an annular flange or collar completely surrounds each tube-receiving hole 14, such flange serving to both increase the heat-conducting path between tube and fin and to establish fin-to-fin axial spacing along the tubes. If desired, longitudinally spaced groups of fins can have different relative angular positions, so that all of the gaps 20 are not longitudinally aligned.

Referring now to FIG. 4, there is illustrated a sheet metal blank 26 upon which is arranged the outline of several fin sections 16. The use of an identical radius R for the inner and outer circumferential edges of each fin section permits adjacent fin sections to be matched or nested in perfect line-to-line contact, with no gap or scrap created between such sections. Furthermore, two oppositely directed rows of such sections can be placed side by side, so that the only scrap created is at areas 28 and 30. Blank 26 may thus be fed in incremental steps into a die so that fin section 18 can be cut or stamped from the blank.

It is to be understood that the illustrated double row arrangement on the blank is only exemplary, the important feature of this embodiment being the line-to-line matching of adjacent inner and outer arcs which results from the use of identical inner and outer radii. Furthermore, it is possible to index the blank a distance $n$ times the width $w$ of a segment (measured at its midpoint) and simultaneously cut $n$ circumferential edges and $n$ pairs of end eges, thus severing any whole number $n$ segments from a single row on the blank with each stroke of the die.

In contrast to the novel fin segments described above, the blank 32 of FIG. 5 has arranged on it a plurality of fin sections 34 formed by circumferentially segmenting an annular fin having conventional concentric inner and outer circumferential edges of unequal radii. The resulting additional scrap material is evident from FIG. 5, wherein the different contours of the inner and outer circumferential edges of adjacent segments leave large scrap areas 36 between segments. The substantial savings in material, resulting from segmenting a non-concentric fin, according to this invention, is evident from a comparison of the blanks of FIGS. 4 and 5.

Figure 6:
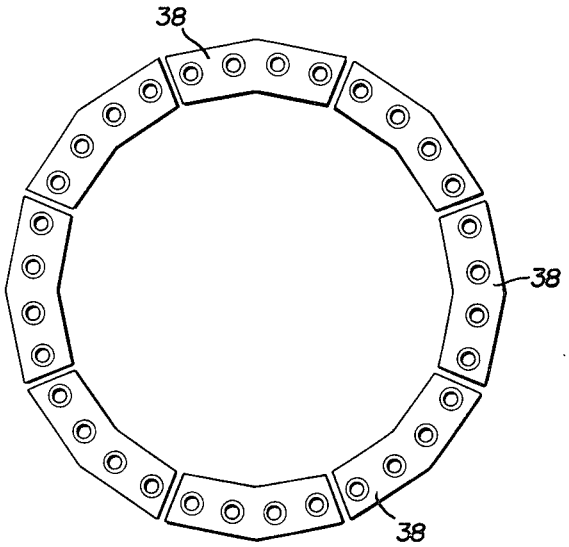
FIG. 6 is an end view, similar to FIG. 2, of a modified fin shape.
Figure 7:
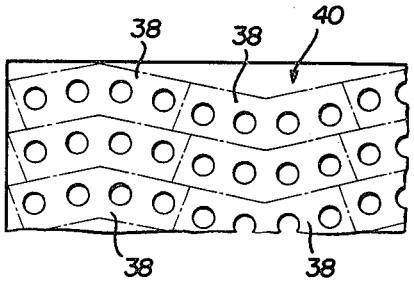
FIG. 7 is a plan view of a blank utilized to form the fin segments of FIG. 6.

It is to be understood that the advantages of the present invention could similary be obtained by using a larger or smaller number of arcuate fin segments for each fin, with the illustrated use of four identical segments being merely exemplary of the present invention. Furthermore, the advantages of this invention would also apply to a non-arcuately shaped annular segment. For example, an annular fin of polygonal shape could be segmented so that each segment was chevron-shaped, but with the inner edge contour still matching that of the outer edge. FIG. 6 illustrates such a configuration, wherein each fin segment 38 is chevron-shaped, having identical inner and outer contours to permit line-to-line nesting on a blank 40, as shown in FIG. 7.

Figure 8:
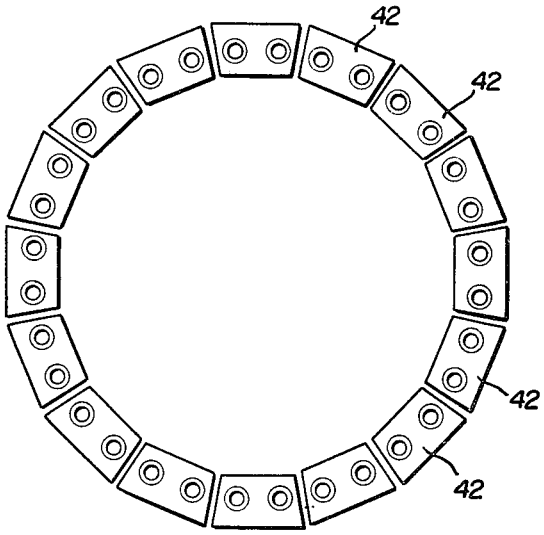
FIG. 8 is an end view, similar to FIG. 6, of a portion of another modified fin shape.
Figure 9:
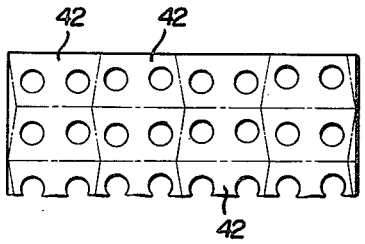
FIG. 9 is a plan view, similar to FIG. 7, of a blank utilized to form the fin segments of FIG. 8.

Similarly, FIG. 8 shows a polygonal fin having straight edge fin segments 42 which lend themselves to a blank arrangement as shown in FIG. 9, or to an end to end single row blank arrangement as in one horizontal row of the blank of FIG. 9.

While the tubes 12 have been illustrated and described as arranged in cylindrical fashion, on a common radius from the axis 18, this arrangement is merely preferred, for reasons such as dynamic balance.

This invention may be further developed within the scope of the following claims. Accordingly, the above specification is to be interpreted as illustrative of only three operative embodiments of the present invention, rather than in a strictly limited sense.

I now claim:

1. In a heat exchanger of the type characterized by a plurality of fluid-carrying tubes arranged in a laterally-spaced, generally cylindrical fashion, and a plurality of generally annular fins spaced longitudinally along said tubes, each annular fin having a plurality of angularly spaced tube-receiving holes arranged in a generally circular pattern to receive each of said tubes, the improved fin construction wherein each of said annular fins comprises a plurality of circumferentially and coplanarly arranged segments having inner and outer edges of identical but radially spaced contour.

2. The heat exchanger of claim 1, wherein the coplanar segments of each fin are circumferentially spaced from each other to provide a slight circumferential gap between the segments of each fin.

3. In a heat exchanger of the type characterized by a plurality of fluid-carrying tubes arranged in a laterally-spaced, generally cylindrical fashion, and a plurality of generally annular fins spaced longitudinally along said tubes, each annular fin having a plurality of angularly spaced tubereceiving holes arranged in a generally circular pattern to receive each of said tubes, the improved fin construction wherein each of said annular fins comprises a plurality of circumferentially and coplanarly arranged generally arcuate segments having inner and outer arcuate edges of identical but radially spaced radii.

4. The heat exhanger of claim 3 wherein said tube-receiving holes are located along an arc of identical radius to that of said inner and outer arcuate edges, which arc is located midway between said inner and outer edges.

* * * * *